US005901604A

United States Patent [19]

Sato et al.

[11] Patent Number: 5,901,604

[45] Date of Patent: May 11, 1999

[54] COAXIAL ENGINE STARTER

[75] Inventors: Yoshikazu Sato, Fukaya; Michio Okada, Gunma; Koji Nara, Maebashi; Masaaki Ohya, Isesaki; Shinichi Nagashima, Ashikaga; Eiichi Kimura, Kiryu, all of Japan

[73] Assignee: Mitsuba Corporation, Gunma-ken, Japan

[21] Appl. No.: 08/979,631

[22] Filed: Nov. 28, 1997

[30] Foreign Application Priority Data

Nov. 29, 1996 [JP] Japan ..... 8-320171
Nov. 29, 1996 [JP] Japan ..... 8-320176

[51] Int. Cl.[6] ..... F02N 15/06

[52] U.S. Cl. ..... 74/7 A; 74/7 E; 290/38 A; 290/48; 335/131

[58] Field of Search ..... 74/7 A, 7 E; 290/38 R, 290/38 A, 38 C, 48; 335/131

[56] References Cited

U.S. PATENT DOCUMENTS 5,023,466 6/1991 Isozumi ..... 290/48
5,118,960 6/1992 Sasamoto et al. ..... 290/48

FOREIGN PATENT DOCUMENTS 8-319926 12/1996 Japan .

*Primary Examiner*—Allan D. Herrmann
*Attorney, Agent, or Firm*—Skjerven, Morrill, MacPherson, Franklin & Friel LLP

[57] ABSTRACT

In an engine starter including a solenoid device for actuating a switch for the electric motor and to drive the pinion into mesh with the ring gear of an internal combustion engine, the solenoid device includes an armature outer member which moves in the direction to push out the pinion against the spring force of a first return spring in the energized state of the solenoid device, and an armature inner member which is resiliently urged by a second return spring, and is telescopically disposed with respect to the armature outer member with a coil spring interposed coaxially between them. An annular spring retainer is press fitted into the inner bore of the armature outer member to receive a corresponding coil end of the coil spring. The spring retainer is stamp formed from non-magnetic material so as to have cylindrical portion which is fitted into the bore of the armature inner member, a flange portion which is bent perpendicularly from the cylindrical portion in the manner of an inwardly directed flange in its installed state, and a guide piece portion which is bent perpendicularly with respect to the axial direction from the free end of the flange portion. The forming of the armature outer member is thereby simplified, and the guide piece portion supports the coil spring with a centering action. More importantly, the spring retainer which may be made of non-magnetic material can prevent any significant leakage of magnetic flux from the spring retainer.

13 Claims, 5 Drawing Sheets

COAXIAL ENGINE STARTER

TECHNICAL FIELD

The present invention relates to an engine starter, and in particular to an engine starter comprising an electric motor, a pinion, a slide shaft for the pinion, and a solenoid device for actuating a switch device all in a coaxial arrangement.

BACKGROUND OF THE INVENTION

In a conventional engine starter, the output shaft axially slidably carrying a pinion which meshes with a ring gear, and the solenoid device for axially driving the pinion were typically arranged in a parallel relationship. According to such a double-shaft type engine starter, because the solenoid device projects sideways from the electric motor, the radial dimension of the starter was inevitably significant, and a substantial restriction was imposed on the necessary mounting space.

To overcome such an inconvenience, there have been proposed a number of coaxial engine starters which have a solenoid device disposed around the output shaft. The Applicant (Assignee) of this application previously proposed in Japanese laid open patent publication No. 8-319926 (United States patent application No. 08/653,873 filed May 28, 1996) a coaxial engine starter that can reduce the axial dimension without complicating the overall structure.

According to this prior patent application, the pinion is coupled with the output shaft via a one-way clutch and a helical spline so that the pinion is pushed toward the ring gear as the output shaft turns. The pinion is further thrust forward by a moveable core or an armature which is magnetically actuated so as to more positively mesh with the ring gear, and the axial dimension is reduced by forming the armature from armature inner and outer members which are nested one in the other. However, if the thrust force is insufficient when the pinion is about to abut the side surface of the ring gear, the pinion may fail to mesh with the ring gear. Therefore, it is desired to increase the magnetic attractive force acting on the armature, and the thrust force of the pinion.

Furthermore, as it is desired to more reliably push the pinion into engagement with the ring gear, a coil spring is interposed between the armature inner member and a fixed part consisting of a top plate for providing a spring force for pushing out the pinion in addition to that provided by the magnetic attractive force.

However, this arrangement has the problem that the coil spring extends as the armature inner member moves in the direction to push out the pinion, and the spring force of the coil spring diminishes by a corresponding degree. To overcome this problem, it is conceivable to move the coil spring with the movement of the armature outer member. By so doing, it is possible to reduce the extension of the coil spring by the amount of the movement of the armature outer member.

According to such an arrangement for supporting the coil spring from the side of the armature outer member, it is conceivable to integrally provide an inwardly directed radial flange on the inner periphery of the armature outer member to engage one of the coil ends of the coil spring. However, it would be difficult and costly to carry it out. Furthermore, the magnetic flux would leak from the flange which is made of the same magnetic material as the armature outer member, thereby reducing the magnetic attraction on the magnetic outer member, and, also, the armature inner member would be magnetically attracted toward the flange (or in the direction to pull it back). The inwardly directed radial flange may also create the problem that the corresponding coil end of the coil spring may shift sideways, and interfere with the armature inner member or other components.

BRIEF SUMMARY OF THE INVENTION

In view of such problems of the prior art, a primary object of the present invention is to provide a coaxial engine starter which can push the pinion into mesh with a ring gear in a highly reliable manner.

A second object of the present invention is to provide a coaxial engine starter which has relatively small radial and axial dimensions but can push out the pinion in a highly powerful manner.

A third object of the present invention is to provide a coaxial engine starter which is economical to manufacture.

A fourth object of the present invention is to provide a coaxial engine starter which is reliable in operation. According to the present invention, these and other objects can be accomplished by providing an engine starter including an electric motor, an output shaft extending coaxially with respect to the electric motor, and a pinion fitted on the output shaft and coupled with the output shaft via a spline, and a solenoid device disposed around the output shaft to drive the pinion into mesh with a ring gear of an internal combustion engine, the solenoid device comprising: an energization coil defining an inner bore; a yoke surrounding the energization coil so as to conduct a magnetic flux axially along an inner circumferential surface of the inner bore of the energization coil; a cylindrical armature outer member received in the inner bore of the energization coil in an axially slidable manner; a cylindrical armature inner member telescopically and axially slidably received in the armature outer member; a first return spring which urges the armature outer member in a direction to open a magnetic gap with respect to the yoke; a second return spring which urges the armature inner member in a direction to open a magnetic gap with respect to the yoke; and a coil spring coaxially interposed between the inner and outer armature members to urge the inner and outer armature members away from each other; an annular spring retainer being fitted into the bore of the armature outer member to engage a corresponding coil end of the coil spring.

Therefore, the shape of the armature outer member is simplified, an the cost of forming the armature outer member is minimized. The spring retainer may be secured in position in both simple and reliable manner by crimping the armature outer member. In particular, the spring retainer may consist of a separate component made of non-magnetic material so that the leakage of magnetic flux via the spring retainer can be minimized. Also, the spring retainer may be provided with an annular boss for restricting lateral movement the corresponding coil end of the coil spring. Thereby, the interference of the coil spring with outer components due to lateral shifting of the coil spring can be avoided in a highly effective manner.

According to a preferred embodiment of the present invention, opposing end portions of the yoke and the armature inner and outer members being provided with substantially complementary tapered longitudinal sections. Typically, the magnetic switch for controlling the electric motor is actuated by the armature outer member.

According to this arrangement, the magnetic attractive force initially acts upon the armature outer member, and this produces a favorable distribution of magnetic flux for the armature inner member so as to be powerfully attracted to the opposing magnetic pole defined on the yoke. This magnetic attractive force is assisted by the coil spring interposed between the armature inner and outer members. Thus, a relatively strong magnetic attractive force is achieved in the early phase of operation, and this force is relatively controlled toward the end of the operation or as the armature members are fully attracted to the opposing pole of the yoke.

In view of controlling the magnetic attractive force toward the end of the movement of the armature members, the armature inner and outer members may be provided with stopper portions in such a manner as to define small gaps between tapered surfaces defined on the armature inner member and the opposing end portion of the yoke, and between tapered surfaces defined on the armature outer member and the opposing end portion of the yoke. It is particularly preferable if at least one of the stopper portions for the armature inner and outer members is defined by an annular shoulder surface, provided in the corresponding armature member perpendicularly to an axial line, which is adapted to abut a corresponding annular shoulder surface defined in the opposing end portion of the yoke in an energized state of the energization coil.

It is advantageous, in view of minimizing undesired leakage of the magnetic flux or the straying of the magnetic flux, if the annular shoulder surface is provided in the armature inner member, and tapered surfaces of the opposing end portion of the yoke and the armature inner member are provided on a same axial side of the annular shoulder surfaces so as to oppose each other with a small gap defined therebetween in an energized state of the energization coil, the tapered surface of the opposing end portion of the yoke being terminated by a recessed portion in such a manner that the tapered surface of the opposing end portion of the yoke extends over a substantially shorter axial length that the tapered surface of the armature inner member does.

To ensure a friction free relative movement between the armature inner and outer members, it is preferable if the armature outer member is disposed coaxially with respect the energization coil by an outer circumferential surface thereof being located by the inner peripheral surface of the bore of the energization coil, and the armature inner member is disposed coaxially with respect to the output shaft by an inner circumferential surface of the armature inner member being located by the outer peripheral surface of the output shaft.

To minimize the leakage of magnetic flux, the output shaft is made of non-magnetic material. Additionally or alternatively, the engine starter may comprise a shifter member made of non-magnetic material and slidably fitted on the output shaft to axially actuate the pinion, the armature inner member being securely fitted on the shifter member. Typically, a one-way clutch is interposed between the pinion and the armature. The one-way clutch is normally made of ferromagnetic material, and it is important to prevent straying of magnetic flux into and through clutch components. Based on this consideration, it is desirable if the one-way clutch includes a clutch inner member which has an end abutting the shifter member, and a clutch outer member which is integrally formed with the pinion, the clutch inner member being engaged by the spline formed on the output shaft. The spline typically consists of a helical spline so as to add a force to push out the pinion.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
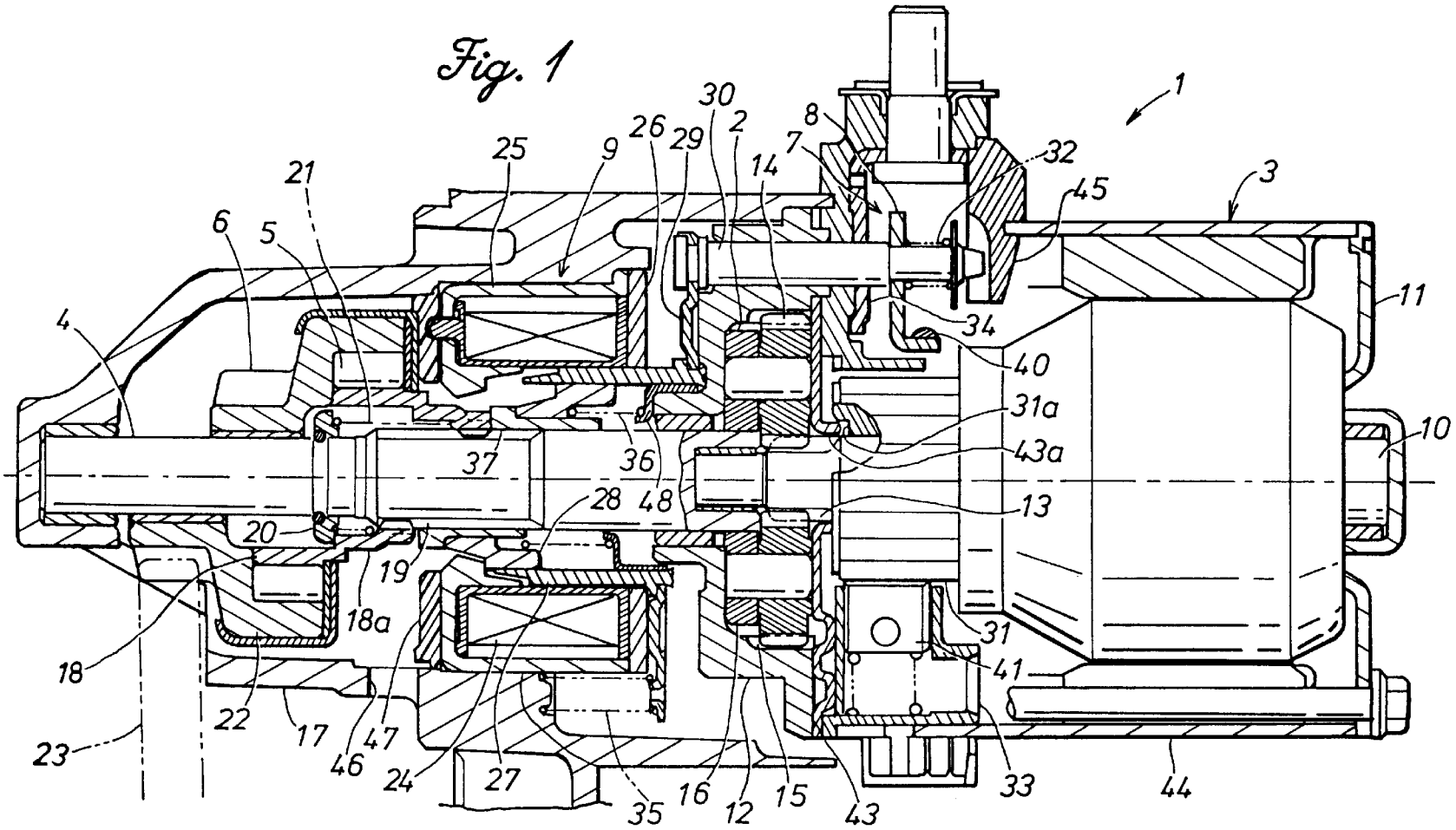
FIG. 1 is a sectional view of an engine starter embodying the present invention.

FIG. 1 generally illustrates an engine starter equipped with a reduction gear unit which is constructed according to the present invention, and the upper half of the drawing illustrates the starter at its inoperative state while the lower half of the drawing illustrates the starter at its operative state. This starter 1 produces a torque which is necessary for cranking an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact plate 8 of the switch unit 7 as well as the pinion 6.

The electric motor 3 consists of a known commutator type DC electric motor, and its rotor shaft 10 is pivotally supported at a center of a bottom plate 11 at its right end as seen in the drawing, and pivotally supported at a center of a right end of the output shaft 4, which is coaxially disposed with respect to the rotor shaft 10, at its left end (on the side of the ring gear 23 of the engine) as seen in the drawing.

The reduction gear unit 2 is provided on the inner surface of the top plate 12 of the electric motor 3. The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the inner periphery of the top plate 12 to mesh with the planetary gears 14. A support plate 16 supporting the planetary gears 14 is attached to the right end of the output shaft 4 which is pivotally supported at the center of the top plate 12.

To the top plate 12 is attached a pinion housing 17 which also serves as a securing bracket for mounting the starter to the engine. The left end of the output shaft 4 is pivotally supported by a central part of the inner surface of the left wall of the pinion housing 17.

The outer circumferential surface of a middle part of the output shaft 4 is provided with a helical spline 19, and an axial end portion of a sleeve 18*a* of a clutch inner member 18 of the one-way roller clutch 5 engages the helical spline 19. The clutch inner member 18 is normally urged to the right (the retracting direction) by a second return spring 21 interposed between the sleeve 18*a* and a stopper plate 20 secured to a left end portion of the output shaft 4. The second return spring 21 is received in an annular gap defined between the inner circumferential surface of the sleeve 18*a* of the clutch inner member 18 and the outer circumferential surface of the output shaft 4.

The tubular clutch inner member 18 engages a clutch outer member 22 of the one-way roller clutch 5 in an axially fast but rotationally free relationship. The clutch outer member 22 is provided with a tapered surface for defining a wedge chamber of the one-way roller clutch 5, and a part of the clutch outer member 22 adjacent to the ring gear 23 is provided with a projection directed to the end wall and the ring gear 23. The outer peripheral part of the projection is integrally formed with the aforementioned pinion 6 which meshes with the ring gear 23 of the engine to drive the same. The clutch outer member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of nonmagnetic material. The energization coil 24 is surrounded by a yoke defined by a cup-shaped holder 25 through which the output shaft 4 is passed and an annular disk 26. In a gap defined between the inner circumferential surface of the energization coil 24 and the outer circumferential surface of the output shaft 4 is disposed an armature outer member 27 serving as an outer moveable core and an armature inner member 28 serving as an inner moveable core, both made of ferromagnetic material, in a mutually coaxial and axially slidable, telescopic manner. The left ends of the armature members 27 and 28 (the ends facing the pinion 6) oppose a projecting boss formed on the inner peripheral part of the holder 25 as a magnetic pole for the armatures 27 and 28.

An annular connecting plate 29 is fitted around the outer periphery of the right end of the armature outer member 27 by placing it against an external radial flange 51 provided integrally with the armature outer member 27. The connecting plate 29 may be secured in position by crimping an axial end portion of the armature outer member 27. A connecting rod 30 which projects axially from an outer peripheral part of the connecting plate 29 is passed through the top plate 12 of the electric motor 3. To the projecting end of the connecting rod 30 is attached the moveable contact plate 8 of the switch unit 7 provided near a commutator 31 of the electric motor 3. The moveable contact plate 8 is mounted on the connecting rod 30 in an axially moveable manner, and is floatingly supported by a coil spring 32 in such a manner that it can be engaged and disengaged with and from a fixed contact plate 34 of the switch unit 7 which is fixedly secured to a brush stay 33 provided around the commutator 31. The armature outer member 27 is always urged to the right by a first return spring 35 interposed between the connecting plate 29 and the inner wall of the pinion housing 17, but is normally at its neutral position separating the moveable and fixed contact plates 8 and 34 from each other (as illustrated above the center line in the drawing.

A coil spring 36 is interposed between the armature inner member 28 and the armature outer member 27 in the axial direction so as to resiliently urge them apart. One of the coil ends of the coil spring 36 is engaged by an annular spring retainer 48 press fitted into the inner bore of the armature outer member 27 at motor side end thereof, and the other coil end is engaged by a recessed axial end surface formed in the inner bore of the armature inner member 28.

Figure 2:
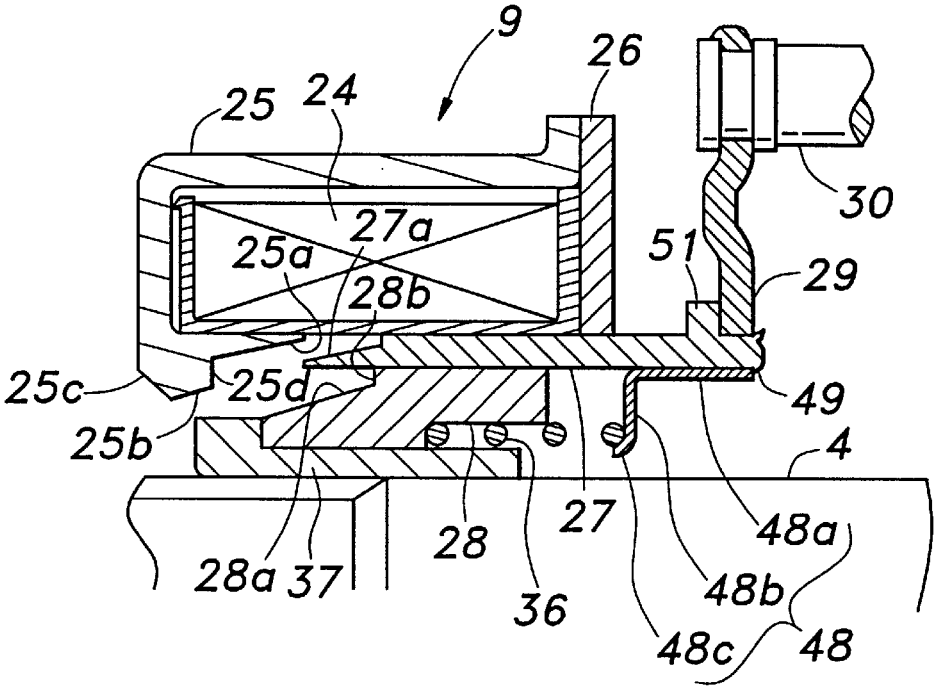
FIG. 2 is an enlarged view of an essential part of the solenoid device for the engine starter shown in FIG. 1.

The spring retainer 48 is formed by stamp forming sheet material made of non-magnetic material, and, as illustrated in FIG. 2, comprises a cylindrical portion 48*a* press fitted into the bore of the armature outer member 27, an internal flange portion 48*b* extending radially from the cylindrical portion 48*a*, and a guide piece portion extending axially or perpendicularly from the outer periphery of the flange portion 48*b*. The inner bore of the armature outer member 27 is provided with a stepped portion 49 which is formed by the bulging of the material as a result of crimping for securing the connecting plate 29 on the outer periphery of the armature outer member 27. The spring retainer 48 is held in position by the stepped portion 49 engaging the cylindrical portion 48*a*.

By thus forming the spring retainer 48 from a member separate from the armature outer member 27, the armature outer member 27 is made simple in shape, and is therefore easy to make. Because the spring retainer 48 can be formed by stamping, it is possible to favorably center the coil spring 36 by supporting the inner bore of the coil end of the coil spring 36 with the guide piece portion 48*c*.

The spring force of the coil spring 36 is weaker than that of the second return spring 21 provided on the clutch inner member 18 under the rest condition of the pinion 6, but becomes greater than that of the second return spring 21 before it is fully compressed by the armature outer member 27 which moves ahead of the armature inner member 28. The left end of the armature inner member 28 engages a shifter member 37 which is made of non-magnetic material and abuts the right end of the clutch outer member 22.

The energization coil 24 is electrically connected to an ignition switch not shown in the drawing via a connector provided in the switch unit 7. The fixed contact plate 34 of the switch unit 7 is electrically connected to the positive terminal of a battery not shown in the drawings, and a pair of pigtails 40 connected to a pair of positive pole brushes 39 are attached to the fixed contact plate 34. A pair of negative pole brushes 41 are provided in a line-symmetrically opposing positions with respect to the positive pole brushes 39. The pigtails 42 for these negative pole brushes 41 are connected to a center plate 43 which is described hereinafter, and are connected to the negative terminal of the battery via the pinion housing 17 and the vehicle body which is not shown in the drawings. The switch unit 7 is provided in a space flanked by the positive pole brushes 39.

The metallic annular center plate 43 is interposed between the brush stay 33 and the top plate 12 to separate the reduction gear unit 2 and the electric motor 3 from each other. From a central portion of the center plate 43 projects an annular boss 43*a* toward the commutator 31 so as to surround the outer periphery of the rotor shaft 10 defining a small gap therebetween. The free end of the annular boss 43*a* fits into a recess 31*a* formed in the axial end surface of the commutator 31 so as to prevent grease in the reduction gear unit 2 from leaking into the commutator 31.

The switch unit 7 is located on top of the starter 1, and the contact unit formed by the fixed contact plate 34 secured to the brush stay 33 and the moveable contact plate 8 are covered by the brush stay 33 and a cover 45 inside the motor casing 44 serving as a yoke. Thereby, brush dust is prevented from entering the contact unit of the switch unit 7.

In this embodiment, as illustrated in the enlarged view of FIG. 2, the end of the armature outer member 27 opposing the above-mentioned inner boss portion of the holder 25 is provided with a tapered projection 27*a*, and the opposing portion of the holder 25 is provided with a tapered projection 25*a* complementary to the tapered projection 27*a*. The end of the armature inner member 28 opposing the inner boss portion of the holder 25 is provided a tapered projection 28*a* which is larger than the tapered projection 27*a*, and the opposing portion of the holder 25 is provided with a tapered receiving portion 25*b* which is partly complementary to the tapered projection 28*a*. The part of the holder 25 which is closer to the pinion 6 than the receiving portion 25*b* thereof is provided with a reversed tapered portion 25*c* to avoid interference with the boss portion 28*a* of the armature inner member 28 when it is pushed forward.

Now the operation of the above described embodiment is described in the following. In the inoperative state, because no electric current is supplied to the energization coil 24, the armature outer member 27 is at its rightmost position under the spring force of the first return spring 35 keeping the connecting plate 29 stationary in engagement with the top plate 12, and the moveable contact plate 8 which is connected to the armature outer member 27 is spaced from the fixed contact plate 34. At the same time, the clutch inner member 18 which is urged by the second return spring 21 is at its rightmost position along with the clutch outer member 22 which is integral with the pinion 6, the shifter member 37 and the armature inner member 28. Thus, the one-way clutch 5 is stationary in engagement with a seal plate 47, and the pinion 6 is disengaged from the ring gear 23 (the state illustrated above the center line of the drawing).

Figure 3:
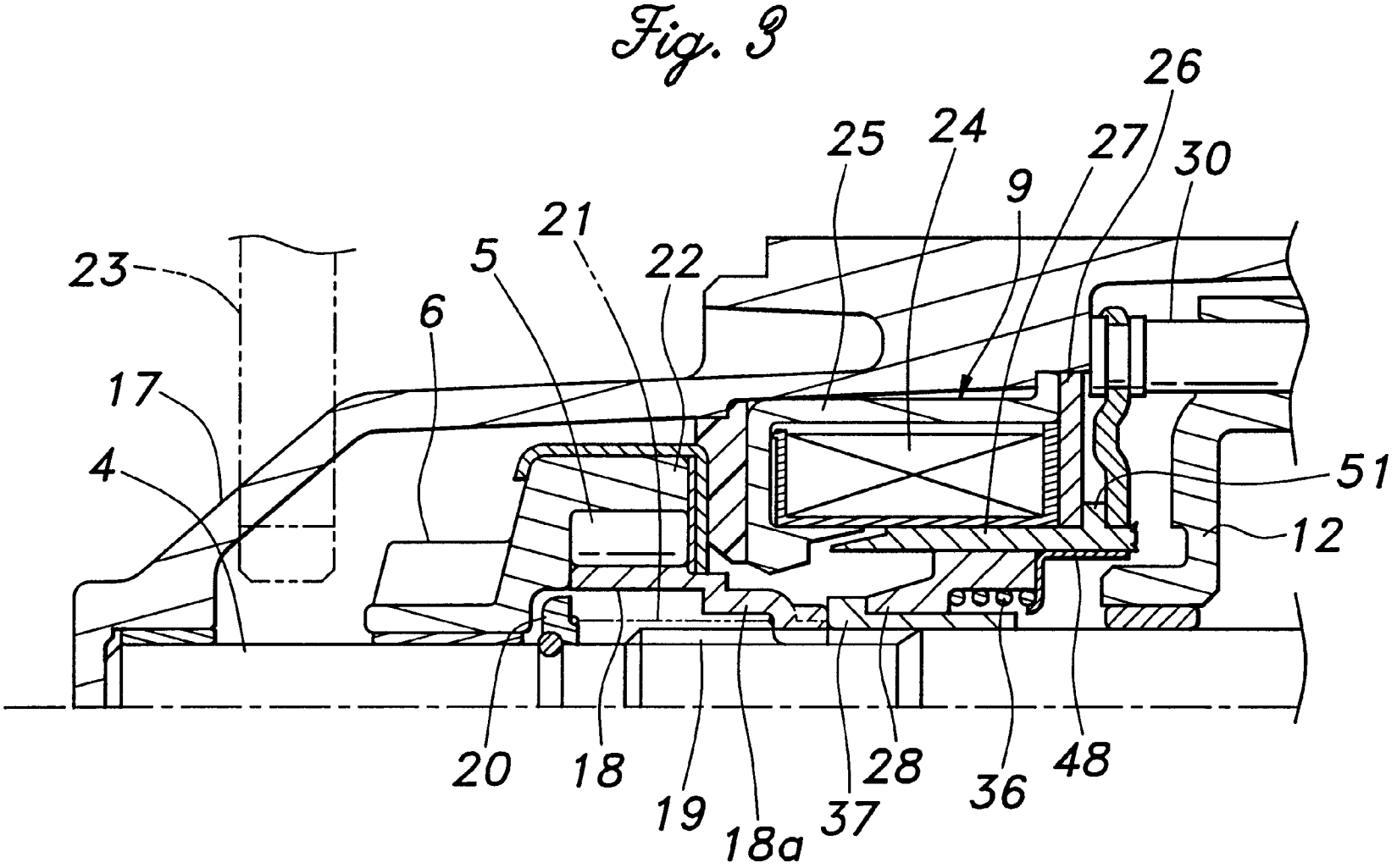
FIG. 3 is an enlarged view of an essential part of FIG. 1 showing the mode of operation of the engine starter.

When the ignition switch is turned to the engine start position, electric current is supplied to the energization coil 24 to magnetize the same. As a result, a magnetic path for conducting a magnetic flux is established in the armature inner and outer members 27 and 28 thereby moving the armature inner and outer members 27 and 28 to the left. At this point, because the projection 27*a* of the armature outer member 27 is closer to the projection 25*a* and the receiving portion 25*b* (pole) of the holder 25 than the projection 28*a* of the armature inner member 28, the armature outer member 27 moves ahead of the armature inner member 28 as illustrated in FIG. 3.

Because the projections 27*a* and 25*a* are tapered as mentioned earlier, the opposing surfaces through which the magnetic flux passes are inclined with respect to the direction of the movement (axial direction), not only a component of the resulting force acts in the direction of movement but also the gap between the tapered surfaces closes as they move toward each other, thereby increasing the magnetic force acting between them.

The armature inner member 28 is resiliently urged in the direction of the movement by the coil spring 36 but the spring force of the coil spring 36 is weaker than the spring force of the second return spring 21 as mentioned above so that the armature inner member 28 remains stationary during an early phase of the attractive movement of the armature outer member 27, and the coil spring 36 is compressed at first.

As a result, the moveable contact plate 8 moves to the left via the connecting plate 29 and the connecting rod 30, and comes into contact with the fixed contact plate 34. This causes electric power to be supplied from the battery to the electric motor 3, and the rotor shaft 10 starts turning. Because the moveable contact plate 8 comes into contact with the fixed contact plate 34 well before the armature outer member 27 completes its fall stroke, and the moveable contact plate 8 is mounted on the connecting rod 30 in a floating relationship so as to be axially moveable, the spring force of the coil spring 32 acts upon the two contact plates 8 and 34.

Meanwhile, the armature outer member 27 comes to a stop with the radial flange 51 provided around the outer periphery thereof for carrying the connecting plate 29 abutting the annular disk 26 with a gap defined between the projection 25*a* and the projection 27*a* as shown in FIG. 3. By thus providing a gap in the stationary state, the leaking magnetic flux applies an attractive force to the armature inner member 28.

In the state shown in FIG. 3, because the pinion 6 is pushed out by the sum of the resilient biasing force which is amplified as a result of the compression of the coil spring 36 and the magnetic attractive force acting upon the armature inner member 28, when the output shaft 4 has started turning or when the rotational speed of the output shaft 4 is still relatively low, the pinion 6 (the clutch outer member 22) moves toward the ring gear 23 along the helical spline 19 while turning in the reverse direction (with respect to the normal rotational direction of the output shaft 4). As the output shaft 4 turns, the frictional resistance at the point of engagement with the helical spline 19 tends to turn the pinion 6 in the normal direction, but, because it is subjected to the sum of the forces mentioned above, the pinion 6 comes into mesh with the ring gear 23 while turning in the reverse direction. At this time, even if the pinion 6 fails to mesh with the ring gear 23 by hitting a side of the teeth of the ring gear 23, because the pinion 6 is pushed forward by the sum of the forces mentioned above and therefore turns in the reverse direction as it is bounced back and about to be brought into mesh with the ring gear 23, and turns in the normal direction when it is prevented from the forward movement by hitting the side of the teeth of the ring gear 23 owing to the helical spline coupling, the pinion 6 can eventually mesh with the ring gear 23 as the pinion 6 turns back and forth.

As the pinion 6 turns with the output shaft 4, the inertial reaction force which tends to move the pinion 6 toward the ring gear 23, owing to the rotation of the output shaft 4 and the spline coupling, becomes weaker. However, according to the present invention, the coil spring 36 urges the armature inner member 28 (the clutch inner member 18) so as to turn the pinion 6 in the reverse direction, and this reverse rotation counteracts the rotation of the pinion 6 dragged by the rotation of the output shaft 4, the thrust force of the pinion 6 owing to the rotation of the output shaft 4, with which the pinion 6 is spline-coupled, increases. Therefore, the pinion 6 can be forced into mesh with the ring gear 23 with an increased thrust.

Figure 4:
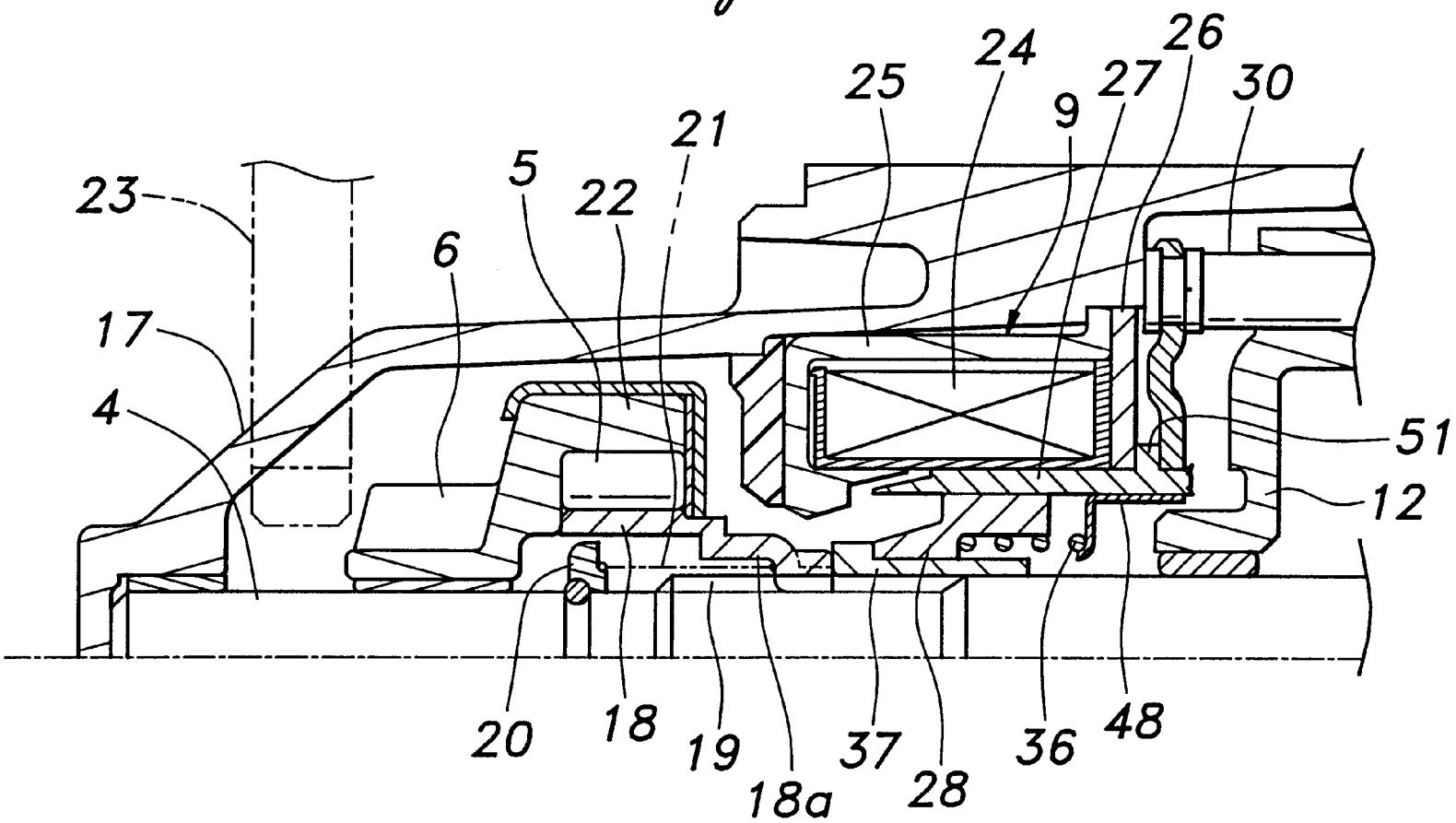
FIG. 4 is a view similar to FIG. 3 showing a different state of the engine starter.
Figure 5:
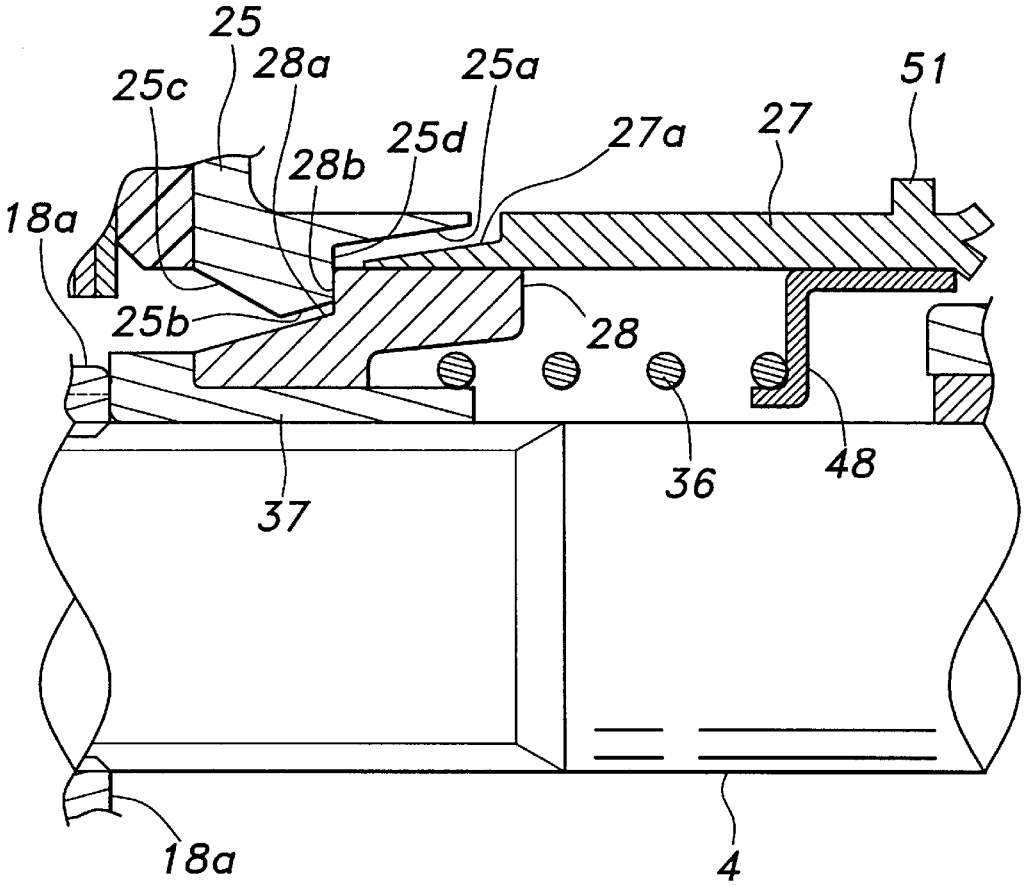
FIG. 5 is a view similar to FIG. 2 showing the state of the engine starter, when the pinion is fully meshed with the ring gear.

FIG. 4 shows the pinion 6 immediately preceding the meshing. When the pinion 6 is brought into mesh with the ring gear 23, the coil spring 36 is also applying a spring force. This spring force continues to push the pinion 6 until the pinion 6 is about to mesh with the ring gear 23, by which time the magnetic attractive force becomes sufficiently strong.

As mentioned in connection with the prior art, when the armature outer member is integrally provided with an internal radial flange for engaging one of the coil ends of the coil spring, because the radial flange is made of magnetic material, the magnetic flux leaks from this flange with the result that the magnetic attractive force for the armature outer member is reduced. Additionally, because the magnetic flux passes between the armature inner member and the flange, an attractive force which draws the armature inner member toward the flange is produced, and this reduces the thrust of the armature inner member. However, according to the present invention, because the spring retainer 48 mounted on the armature outer member 27 is made of non-magnetic material, there is no leakage of magnetic flux via the spring retainer 48, and the above mentioned problem can be eliminated.

Once the pinion 6 starts meshing with the ring gear 23, the pinion 6 which is coupled with the output shaft 4 by the helical spline can move into full mesh with the ring gear 23 as the output shaft 4 turns. When the pinion 6 has thus fully meshed with the ring gear 23, the clutch inner member 18 is engaged by the stopper plate 20 and is thereby prevented from moving further in the axial direction so that the rotation of the output shaft 4 is transmitted to the ring gear 23 via the pinion 6 which is coupled with the output shaft 4 by the helical spline, and the engine is cranked.

At this time point, as shown by the lower half of FIG. 1, the left end surface 28*b* of the armature inner member 28 which is perpendicular to lo the axial line thereof abuts an abutting surface 25*d* of the holder 25 which is also perpendicular to the axial line thereof, and a slight gap is created between the tapered surfaces of the boss portion 28*a* and the receiving portion 25*b*. This is for the purpose of producing a large attractive thrust force by opposing the two tapered surfaces to each other, and increasing the magnetic force as the two tapered surfaces come closer to each other until the magnetic flux is finally passed axially across the gap instead of across the tapered surfaces. Further, as compared with the axial length of the tapered surface of the boss portion 28*a* , the axial length of the tapered surface of the receiving portion 25*b* (about half the length in this embodiment). This is for the purpose of preventing a large amount of magnetic flux from being produced between the two tapered surfaces while the axially left end surface 28*a* of the armature inner member 28 and the abutting surface 25*d* of the holder 25 are abutting each other, and to increase the magnetic flux which is directed in the axial direction between the end surface 28*b* and the abutting surface 25*d* so as to increase the magnetic attractive force.

The attractive force of the energization coil 24 acting on the armature inner member 28 is maximized by the armature inner member 28 abutting the abutting surface 25*d* of the holder 25 so that even when the pinion 6 is subjected to a force which tends to dislodge the pinion 6 from the ring gear 23, the shifter member 37 prevents it from occurring by stopping the rightward movement of the clutch inner member 18.

The electric current required to keep the armature members 27 and 28 stationary after they have moved their full stroke is smaller than that required to start the movement of the armature members 27 and 28. In other words, by utilizing the axial force produced by the helical spline 19 for initiating the movement of the one-way clutch 5 along with the pinion 6, the necessary output of the energization coil 24 can be reduced, and the size of the energization coil 24 can be reduced. Once the engine has started, and the engine speed exceeds the rotational speed of the pinion 6, this arrangement is no different from the conventional arrangement in that the pinion 6 is allowed to rotate freely by virtue of the one-way clutch 5.

When the supply of electric current to the energization coil 24 is terminated, the biasing force of the second return spring 21 acting upon the clutch inner member 18 and the biasing force of the first return spring 35 acting upon the armature outer member 27 cause the pinion 6 to disengage from the ring gear 23, and the moveable contact plate 8 to move away from the fixed contact plate 34, thereby stopping the electric motor 3.

Figure 6:
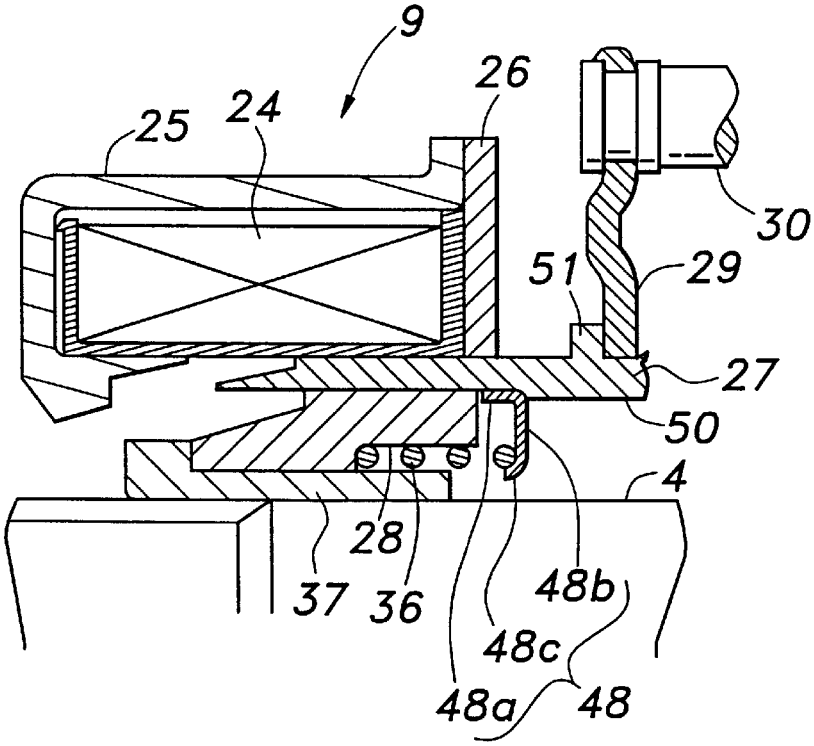
FIG. 6 is a view similar to FIG. 2 showing a second embodiment of the present invention.

FIG. 6 shows a second embodiment of the present invention, and the parts corresponding to those of the previous embodiment are denoted with like numerals without repeating the description thereof. Whereas the cylindrical portion 48*a* and the guide piece portion 48*c* were bent in different directions with respect to the flange portion 48*b* so as to define a crank shaped longitudinal section in the above described embodiment, the cylindrical portion 48*a* and the guide piece portion 48*c* of the illustrated embodiment are bent in a same direction with respect to the flange portion 48*b* so as to define a C-shaped longitudinal section. The inner circumferential surface of the armature outer member 27 is provided with a stepped portion 50 which engages and secures the cylindrical portion 48*a*. This embodiment provides substantially same advantages as the previously described embodiment.

As mentioned earlier, the pinion 6 is formed integrally with the clutch outer member 22. This is advantageous because the thick-walled portion of the end wall for forming the tapered surface of the wedge chamber of the one-way roller clutch is located on the side of the pinion 6 or the ring gear 23 so that the thick-walled portion is formed remote from the holder 25 so that the lack of the thick-walled portion on the side of the holder 25 minimizes the leakage of magnetic flux on the side of the holder 25.

The armature outer member 27 is assembled by locating the outer periphery thereof with respect to the inner circumferential surface of the coil bobbin of the energization coil 24, and the armature inner member 28 is assembled by locating the inner periphery thereof with respect to the outer circumferential surface of the shifter member 37 which, for instance, made of synthetic resin material. Thereby, a gap is defined between the inner circumferential surface of the armature outer member 27 and the outer circumferential surface of the armature inner member 28 so that the jamming of these two parts during their movement can be avoided.

The pinion housing 17 is provided with a drain hole 46 at a lower part thereof in its assembled state. This drain hole 46 is provided near the seal plate 47 for both locating the solenoid device 9 on the side of the rest position of the pinion, and repelling water. The solenoid device 9 is enclosed by the pinion 6 in the rest state of the starter, but a gap is produced between the pinion 6 and the solenoid device 9 once the pinion 6 has moved and meshed with the ring gear 23, and this gap may permit the intrusion of water. This can be avoided by the seal plate 47, and removal of water is even more enhanced by the provision of the drain hole 46 provided in front of the seal plate 47.

Thus, according to the present invention, the spring retainer can be made by stamping non-magnetic sheet material, and the undesired leakage of magnetic flux from the armature can be avoided. Furthermore, the shape of the armature can be simplified, and can be made easier to manufacture. By providing a guide piece portion, the coil spring can be retained with a certain centering action so that the dislodging of the coil end of the coil spring, and the resulting interference of the coil with other parts can be avoided.

Although the present invention has been described in terms of preferred embodiments thereof, it is obvious to a person skilled in the art that various alterations and modifications are possible without departing from the scope of the present invention which is set forth in the appended claims.

What we claim is:

1. A coaxial engine starter including an electric motor, an output shaft extending coaxially with respect to said electric motor, and a pinion fitted on said output shaft and coupled with said output shaft via a spline, and a solenoid device disposed around said output shaft to drive said pinion into mesh with a ring gear of an internal combustion engine, said solenoid device comprising:

an energization coil defining an inner bore;

a yoke surrounding said energization coil so as to conduct a magnetic flux axially along an inner circumferential surface of said inner bore of said energization coil;

a cylindrical armature outer member received in said inner bore of said energization coil in an axially slidable manner;

a cylindrical armature inner member telescopically and axially slidably received in said armature outer member;

a first return spring which urges said armature outer member in a direction to open a magnetic gap with respect to said yoke;

a second return spring which urges said armature inner member in a direction to open a magnetic gap with respect to said yoke; and a coil spring coaxially interposed between said inner and outer armature members to urge said inner and outer armature members away from each other;

an annular spring retainer being fitted into the bore of said armature outer member to engage a corresponding coil end of said coil spring.

2. A coaxial engine starter according to claim 1, wherein said spring retainer is secured in position by crimping said armature outer member.

3. A coaxial engine starter according to claim 1, wherein said spring retainer is made of non-magnetic material.

4. A coaxial engine starter according to claim 1, wherein said spring retainer is provided with an annular boss for restricting lateral movement of the corresponding coil end of said coil spring.

5. A coaxial engine starter according to claim 1, wherein opposing end portions of said yoke and said armature inner and outer members are provided with substantially complementary tapered longitudinal sections.

6. A coaxial engine starter according to claim 5, wherein said armature inner and outer members are provided with stopper portions in such a manner as to define small gaps between tapered surfaces defined on said armature inner member and said opposing end portion of said yoke, and between tapered surfaces defined on said armature outer member and said opposing end portion of said yoke.

7. A coaxial engine starter according to claim 6, wherein at least one of said stopper portions for said armature inner and outer members is defined by an annular shoulder surface, provided in the corresponding armature member perpendicularly to an axial line, which is adapted to abut a corresponding annular shoulder surface defined in said opposing end portion of said yoke in an energized state of said energization coil.

8. A coaxial engine starter according to claim 7, wherein said annular shoulder surface is provided in said armature inner member, and tapered surfaces of said opposing end portion of said yoke and said armature inner member are provided on a same axial side of said annular shoulder surfaces so as to oppose each other with a small gap defined therebetween in an energized state of said energization coil, said tapered surface of said opposing end portion of said yoke being terminated by a recessed portion in such a manner that said tapered surface of said opposing end portion of said yoke extends over a substantially shorter axial length than said tapered surface of said armature inner member does.

9. A coaxial engine starter according to claim 1, wherein said armature outer member is disposed coaxially with respect said energization coil by an outer circumferential surface thereof being located by the inner peripheral surface of said bore of said energization coil, and said armature inner member is disposed coaxially with respect to said output shaft by an inner circumferential surface of said armature inner member being located by the outer peripheral surface of said output shaft.

10. A coaxial engine starter according to claim 9, wherein said output shaft is made of non-magnetic material.

11. A coaxial engine starter according to claim 9, further comprising a shifter member made of non-magnetic material and slidably fitted on said output shaft to axially actuate said pinion, said armature inner member being securely fitted on said shifter member.

12. A coaxial engine starter according to claim 11, further comprising a one-way clutch having a clutch inner member having an end abutting said shifter member, and a clutch outer member integrally formed with said pinion, said clutch inner member being engaged by said spline formed on said output shaft.

13. A coaxial engine starter according to claim 12, wherein said spline consists of a helical spline.

* * * * *